US006499971B2

(12) United States Patent
Narney, II et al.

(10) Patent No.: US 6,499,971 B2
(45) Date of Patent: Dec. 31, 2002

(54) COMPRESSOR UTILIZING SHELL WITH LOW PRESSURE SIDE MOTOR AND HIGH PRESSURE SIDE OIL SUMP

(75) Inventors: John Kenneth Narney, II, Bristol, VA (US); David Turner Monk, Bristol, VA (US); Thomas Evans Goodnight, Aiken, SC (US)

(73) Assignee: Bristol Compressors, Inc., Bristol, VA (US)

( * ) Notice: Subject to any disclaimer, the term of this patent is extended or adjusted under 35 U.S.C. 154(b) by 0 days.

(21) Appl. No.: 09/726,606

(22) Filed: Dec. 1, 2000

(65) Prior Publication Data

US 2002/0067998 A1 Jun. 6, 2002

(51) Int. Cl.[7] ..... F04B 35/04
(52) U.S. Cl. ..... 417/410.3; 418/94; 417/366
(58) Field of Search ..... 417/410.3, 366; 418/94; 184/6.16

(56) References Cited

U.S. PATENT DOCUMENTS

| | | | | |
|---|---|---|---|---|
| 2,551,623 A | * | 5/1951 | More | 417/410.3 |
| 3,325,085 A | | 6/1967 | Gaus | 230/55 |
| 3,410,478 A | * | 11/1968 | Geisenhaver | 417/366 |
| 3,514,225 A | * | 5/1970 | Monden et al. | 417/410.1 |
| 3,618,337 A | * | 11/1971 | Mount | 62/505 |
| 3,687,233 A | | 8/1972 | Greenwald | |
| 3,790,311 A | * | 2/1974 | Butts et al. | 417/410 |
| 3,825,372 A | | 7/1974 | Lundberg et al. | |
| 4,403,927 A | | 9/1983 | Butterworth et al. | |
| 4,488,855 A | | 12/1984 | Butterworth et al. | |
| 4,569,645 A | | 2/1986 | Asami et al. | |
| 4,834,627 A | | 5/1989 | Gannaway | |
| 4,854,831 A | | 8/1989 | Etemad et al. | |
| 4,915,554 A | | 4/1990 | Serizawa et al. | 418/94 |

(List continued on next page.)

FOREIGN PATENT DOCUMENTS

| | | |
|---|---|---|
| EP | 0 855 514 | 7/1998 |
| JP | 60-47893 | 3/1985 |
| JP | 62-29790 | 2/1987 |
| JP | 3-179193 | 8/1991 |
| JP | 4-22783 | 1/1992 |
| JP | 4-101100 | 4/1992 |
| JP | 4-321787 | 11/1992 |
| JP | 5-288185 | 11/1993 |

*Primary Examiner*—Charles G. Freay
*Assistant Examiner*—John F Belena
(74) *Attorney, Agent, or Firm*—Finnegan, Henderson, Farabow, Garrett & Dunner, L.L.P.

(57) ABSTRACT

A compressor system includes a housing with a low pressure first chamber and a high pressure second chamber. A motor in the first chamber has a shaft that passes into the second chamber. A compressor in the housing is operably connected to the motor by the shaft. The second chamber contains an oil sump storing lubricating oil for the compressor. A fluid path through the compressor system includes a first orifice in the housing communicating a suction tube with the first chamber, a first fluid passage communicating the first chamber with the compressor suction port, a second fluid passage communicating the compressor discharge port with the second chamber, and a second orifice in the housing communicating the second chamber with a discharge tube. By the action of the compressor, the fluid in the first chamber is maintained at compressor suction pressure and the fluid in the second chamber is maintained at compressor discharge pressure. Placement of the motor in the low pressure chamber allows operation of the compressor system in environments with high ambient temperatures without adverse effects on the motor performance. Lubricating oil is separated from the compressed fluid with a baffle in the high pressure chamber. Further oil separation can be carried out using a weighted disk secured on the shaft in the high pressure chamber. Fluid discharged from the compressor can be directed onto the rotating weighted disk, which propels oil in the fluid onto the inner wall of the housing. The separated oil drains into the oil sump.

35 Claims, 4 Drawing Sheets

U.S. PATENT DOCUMENTS 4,934,910 A 6/1990 Utter
4,993,930 A 2/1991 Uchida et al.
5,037,278 A 8/1991 Fujio et al.
5,055,010 A 10/1991 Logan ..... 417/410
5,064,356 A 11/1991 Horn
5,142,885 A 9/1992 Utter et al.
5,286,179 A 2/1994 Forni et al.
5,498,143 A 3/1996 Dreiman et al.
5,533,875 A 7/1996 Crum et al.
5,954,482 A 9/1999 Ijiri et al.
5,980,222 A 11/1999 Fry
6,261,071 B1 * 7/2001 Williams et al. ..... 417/366

* cited by examiner

COMPRESSOR UTILIZING SHELL WITH LOW PRESSURE SIDE MOTOR AND HIGH PRESSURE SIDE OIL SUMP

BACKGROUND OF THE INVENTION

1. Field of the Invention

The present invention relates to a compressor unit, and more particularly to a compressor system with a housing having a low pressure side containing a motor and a high pressure side containing an oil sump.

2. Description of the Related Art

Rotary and swing link compressor systems are known in the art. These conventional systems include high pressure systems and low pressure systems in which a motor and a compressor are contained in a single chamber within a housing. In high pressure systems, the housing is provided with a suction tube that draws fluid into the compression volume of the compressor. The compressed fluid is then discharged into the chamber where it cools the motor before leaving the housing through a discharge tube. In this arrangement the chamber is maintained at the compressor discharge pressure.

In low pressure systems, the chamber is maintained at the compressor suction pressure. In this arrangement the suction tube draws fluid into the chamber where it cools the motor before being drawn into the compressor suction port. The compressed fluid passes from the compression volume of the compressor out of the housing through the discharge tube.

There are a number of problems associated with both conventional compressor arrangements. In high pressure systems, the motor reaches excessively high temperatures when operating in environments with high ambient temperatures. High operating temperatures lead to motor failures and a shortened operational life. In low pressure systems, difficulties arise because lubrication must be provided to the compressor at high pressure to prevent compressed fluid from leaking across the compressor's sealing surfaces. Difficulties can also arise when trying to separate the lubricating oil from the compressed fluid.

Finally, in both arrangements the motor shaft is prone to excessive vibration. High vibration levels result in high operational noise levels. Further, excessive vibration can reduce the operational life of the motor, the bearings, and the compressor. Large balance weights have been secured to the rotor in an attempt to reduce the vibration, but the added weight can result in large deflections of the rotor that further degrade system performance.

SUMMARY OF THE INVENTION

To overcome the drawbacks of the prior art and in accordance with the purpose of the invention, as embodied and broadly described herein, an embodiment of the invention provides a compressor system including a housing, a partition within the housing defining a first chamber and a second chamber, a motor disposed in the first chamber, a compressor disposed within the housing operably connected to the motor, an oil sump disposed in the second chamber, a first orifice in the housing communicating a suction tube with the first chamber, and a second orifice in the housing communicating the second chamber with a discharge tube. Fluid in the first chamber is at compressor suction pressure and fluid in the second chamber is at compressor discharge pressure.

According to an embodiment of the present invention, the compressor is disposed in the first chamber. In an alternative embodiment, the compressor is disposed in the second chamber.

The invention further includes a first fluid passage communicating the first chamber with a suction port of the compressor and a second fluid passage communicating a discharge port of the compressor with the second chamber. Further, one of the first fluid passage and the second fluid passage comprises an orifice in the partition.

According to the invention, the compressor is operably connected to the motor by a shaft passing through the partition. One embodiment of the invention includes a weight disposed on the shaft in the second chamber balancing the shaft. The weight can include a disk positioned so that fluid discharged from the compressor is directed onto the disk, whereby oil is centrifugally separated from the fluid. According to an embodiment of the invention, the partition comprises a shaft bearing.

According to the invention, the first orifice is in a location between the partition and the motor.

An embodiment of the present invention further provides a compressor system including a housing, a partition within the housing defining a low pressure housing portion and a high pressure housing portion, a motor in the low pressure housing portion, a compressor in the housing operably connected to the motor, an oil sump in the high pressure housing portion, a first orifice in the housing communicating a suction tube with the low pressure housing portion, a first fluid passage communicating the low pressure housing portion with a suction port of the compressor, a second fluid passage communicating a discharge port of the compressor with the high pressure housing portion, and a second orifice in the housing communicating the high pressure housing portion with a discharge tube. Oil in fluid discharged from the compressor is deposited in the oil sump.

In one embodiment, the compressor is disposed in the low pressure housing portion. In an alternative embodiment, the compressor is disposed in the high pressure housing portion.

According to the invention, the compressor maintains the low pressure housing portion at suction pressure and the high pressure housing portion at discharge pressure. Further, in one embodiment, the fluid discharged from the compressor is directed onto a rotating disk that centrifugally separates the oil from the fluid.

A further embodiment of the invention provides a compressor system having a first chamber at suction pressure and a second chamber at discharge pressure, the system including a housing, a partition within the housing defining the first chamber and the second chamber, a first orifice in the housing communicating a suction tube with the first chamber, a second orifice in the housing communicating the second chamber with a discharge tube, a motor disposed in the first chamber having a shaft passing through the partition, an oil sump disposed in the second chamber, and a compressor disposed in the housing operably connected to the shaft. The compressor includes a compressor inlet communicating the first chamber with a compression volume and a compressor outlet communicating the compression volume with the second chamber.

According to one embodiment of the present invention, the compressor is disposed in the first chamber. Further, the compressor outlet passes though the partition. In an alternative embodiment, the compressor is disposed in the second chamber and the compressor inlet passes through the partition.

A further embodiment of the invention includes an oil separation device disposed in the second chamber interacting with fluid from the compressor outlet to separate oil from the fluid. The oil separation device can include a disk disposed on the shaft that propels the oil onto an inner surface of the housing. Further, the disk can be weighted to balance the shaft.

An alternative embodiment of the invention provides a compressor system including a housing, a compressor disposed within the housing dividing an interior housing space into a first chamber and a second chamber, a motor disposed in the first chamber operably connected to the compressor, an oil sump disposed in the second chamber, a first orifice in the housing communicating a suction tube with the first chamber, and a second orifice in the housing communicating the second chamber with a discharge tube. Fluid in the first chamber is at compressor suction pressure and fluid in the second chamber is at compressor discharge pressure.

A further embodiment of the invention includes a seal between the compressor and the housing to prevent fluid passage between the chambers. In an alternative embodiment, the compressor is sealed with respect to the housing to prevent fluid passage between the chambers.

According to the invention, the first orifice is in a location between the compressor and the motor. Further, the motor is operably connected to the compressor by a shaft extending from the motor into the second chamber.

A further embodiment of the invention includes a weight disposed on the shaft in the second chamber balancing the shaft. Further, the weight can include a disk positioned so that fluid discharged from the compressor is directed onto the disk, whereby oil is centrifugally separated from the fluid.

According to another embodiment, the invention provides a compressor system, including a housing, a compressor within the housing dividing an internal housing space into a low pressure housing portion and a high pressure housing portion, a motor in the low pressure housing portion operably connected to the compressor, an oil sump in the high pressure housing portion, a first orifice in the housing communicating a suction tube with the low pressure housing portion, a first fluid passage communicating the low pressure housing portion with a suction port of the compressor, a second fluid passage communicating a discharge port of the compressor with the high pressure housing portion, and a second orifice in the housing communicating the high pressure housing portion with a discharge tube. Oil in fluid discharged from the compressor is deposited in the oil sump.

According to the invention, the compressor maintains the low pressure housing portion at suction pressure and the high pressure housing portion at discharge pressure. Further, in one embodiment, the fluid discharged from the compressor is directed onto a rotating disk that centrifugally separates the oil from the fluid.

Another embodiment of the invention provides a compressor system having a first chamber at suction pressure and a second chamber at discharge pressure, the system including a housing, a compressor disposed within the housing dividing an interior housing space into the first chamber and the second chamber, a first orifice in the housing communicating a suction tube with the first chamber, a second orifice in the housing communicating the second chamber with a discharge tube, a motor disposed in the first chamber having a shaft driving the compressor, and an oil sump disposed in the second chamber. The compressor includes a compressor inlet communicating the first chamber with a compression volume and a compressor outlet communicating the compression volume with the second chamber.

In another embodiment, the invention includes an oil separation device disposed in the second chamber interacting with fluid from the compressor outlet to separate oil from the fluid. The oil separation device can include a disk disposed on the shaft that propels the oil onto an inner surface of the housing. Further, the disk can be weighted to balance the shaft.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DESCRIPTION OF THE PREFERRED EMBODIMENTS

Figure 1:
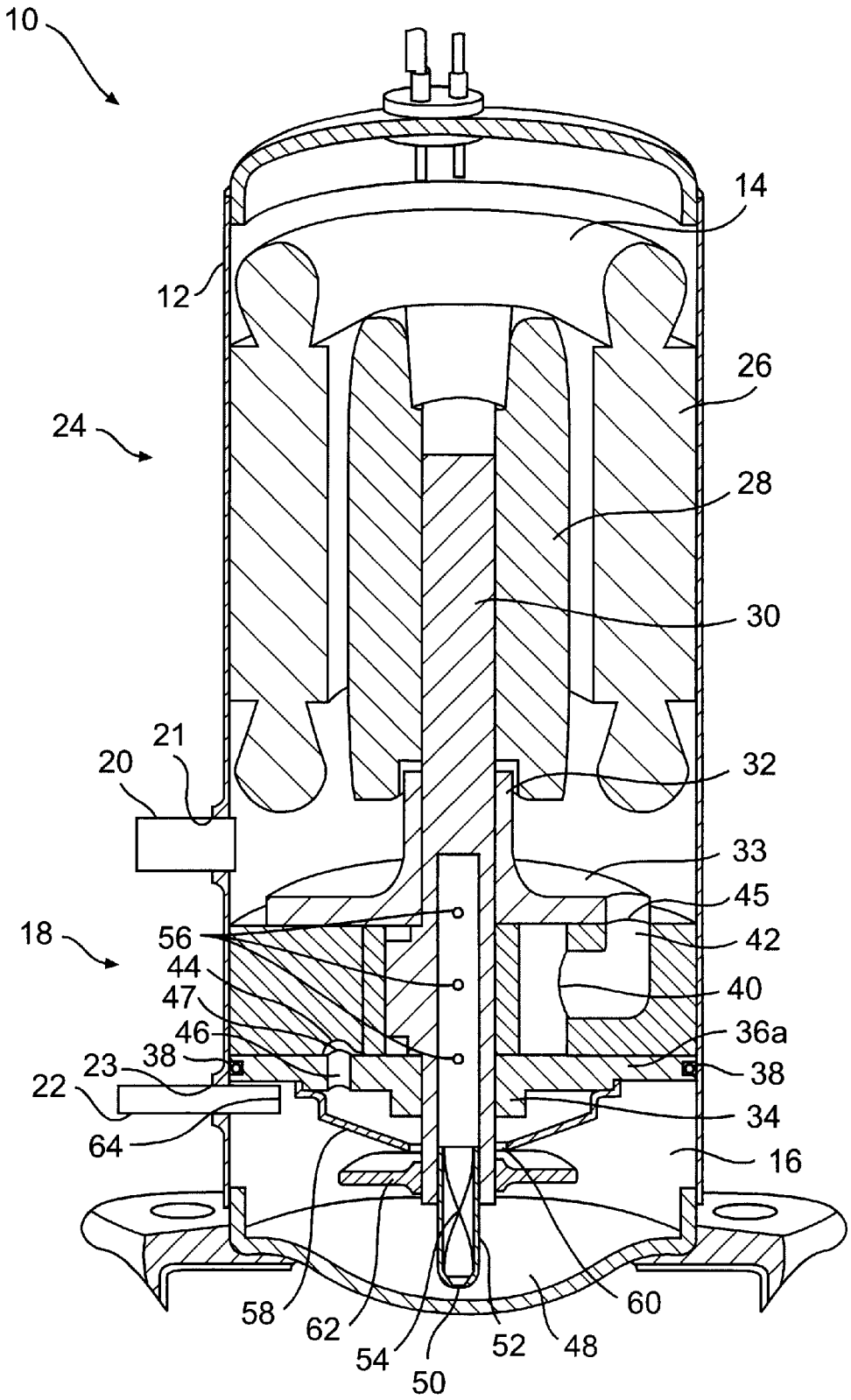
FIG. 1 is a cross-sectional view of a first embodiment of the present invention.

Reference will now be made in detail to the present preferred embodiments of the invention, examples of which are illustrated in the accompanying drawings. Wherever possible, the same reference numbers will be used throughout the drawings to refer to the same or like parts.

As shown in FIGS. 1–4, the compressor system 10 of the present invention includes a housing 12 divided into a first chamber 14 and a second chamber 16. A compressor 18 within the housing 12 draws fluid, such as refrigerant, through a suction tube 20 into the first chamber 14, and then into the compressor 18 where it compresses the fluid. The suction tube 20 passes through a first orifice 21 in the housing 12. The compressed fluid is then expelled from the compressor 18 into the second chamber 16, where it leaves the housing 12 through a discharge tube 22. The discharge tube 22 passes through a second orifice 23 in the housing 12. The fluid in the first chamber 14 is thereby maintained at the compressor's suction pressure (low pressure) and the fluid in the second chamber 16 is maintained at the compressor's discharge pressure (high pressure). A conventional rotary compressor is shown in the drawings, but other types of compressors known in the art may be used.

A motor 24, including a stator 26 and a rotor 28, used to power the compressor 18 is mounted in the first chamber 14. Placement of the motor 24 in this cooler, low pressure chamber 14 allows the compressor system 10 to operate in environments with high ambient temperatures without adverse effects on the motor performance. The rotor 28 is mounted on a first end of a shaft 30. The shaft 30, which is supported by bearings 32,34, extends from the first chamber 14 into the second chamber 16.

In the first embodiment of the invention, shown in FIG. 1, the internal housing space is divided into first and second chambers 14,16 by a partition plate 36*a*. The plate 36*a* can be provided with a pressure seal 38 along its interface with the housing 12 to maintain the pressure differential between the chambers 14,16. Other conventional methods of sealing the plate 36*a* with respect to the housing 12 are envisioned, including a press fit arrangement. In this embodiment, the compressor 18 is mounted above the partition plate 36*a* in the first chamber 14. Upper and lower bearings 32,34 support the shaft 30, which passes through the compressor 18 and the partition plate 36*a*. The upper shaft bearing 32 is supported on an upper shaft bearing plate 33. The lower shaft bearing 34 can be formed integrally with the partition plate 36*a,* as shown in FIG. 1. Alternatively, a separate bearing can be added adjacent to the plate 36*a*.

Figure 2:
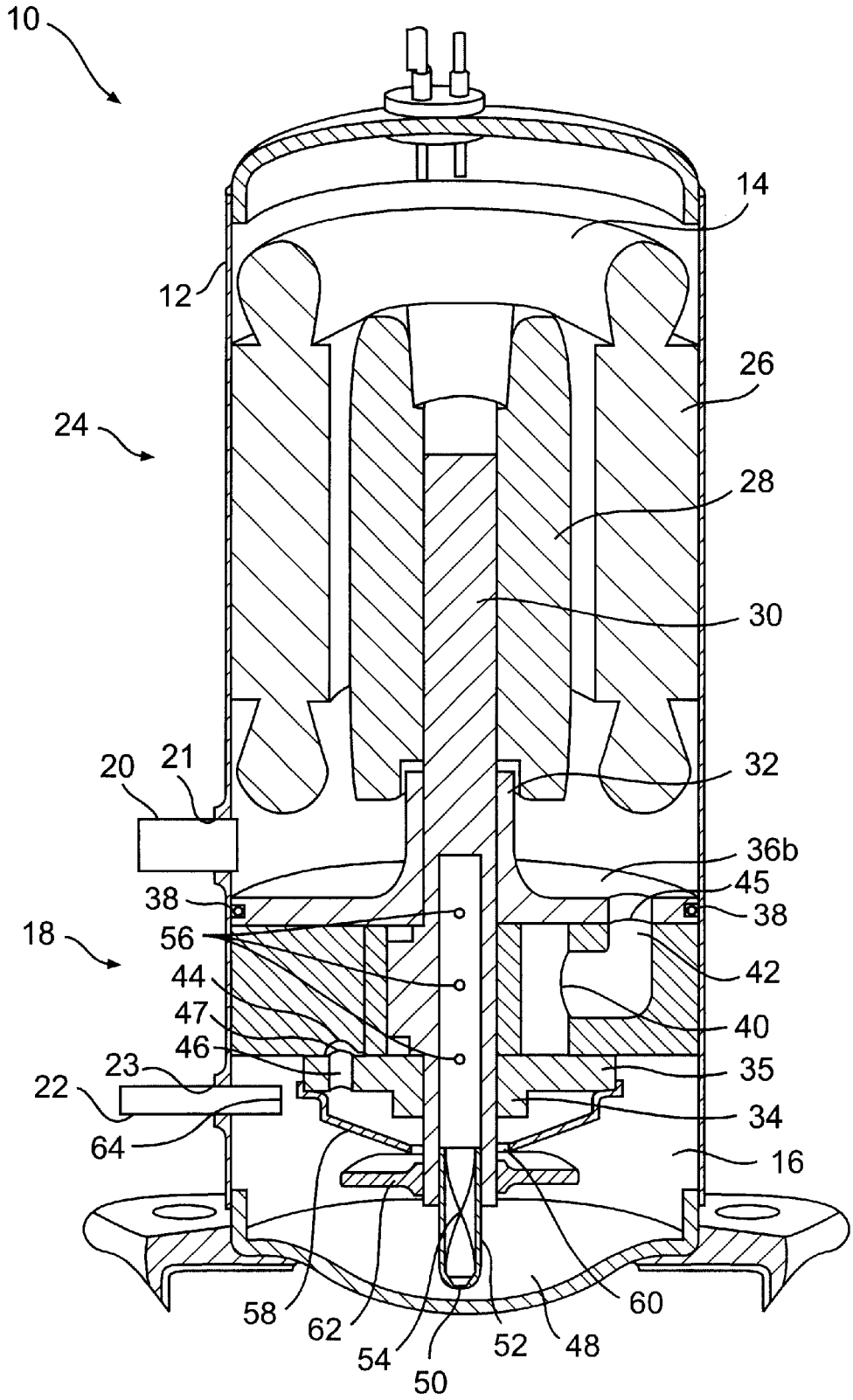
FIG. 2 is a cross-sectional view of a second embodiment of the present invention.

The second embodiment of the invention is shown in FIG. 2. A partition plate 36*b* is again used to divide the internal housing space into first and second chambers 14,16. The plate 36*b* can be provided with a pressure seal 38 to maintain the pressure differential between the chambers 14,16. In this embodiment, the compressor 18 is mounted below the partition plate 36*b* in the second chamber 16. As shown in FIG. 2, the upper shaft bearing 32 can be formed integrally with the partition plate 36*b*. Alternatively, a separate bearing can be added adjacent to the plate 36*b*. The lower shaft bearing 34 is supported on a lower shaft bearing plate 35.

Figure 3:
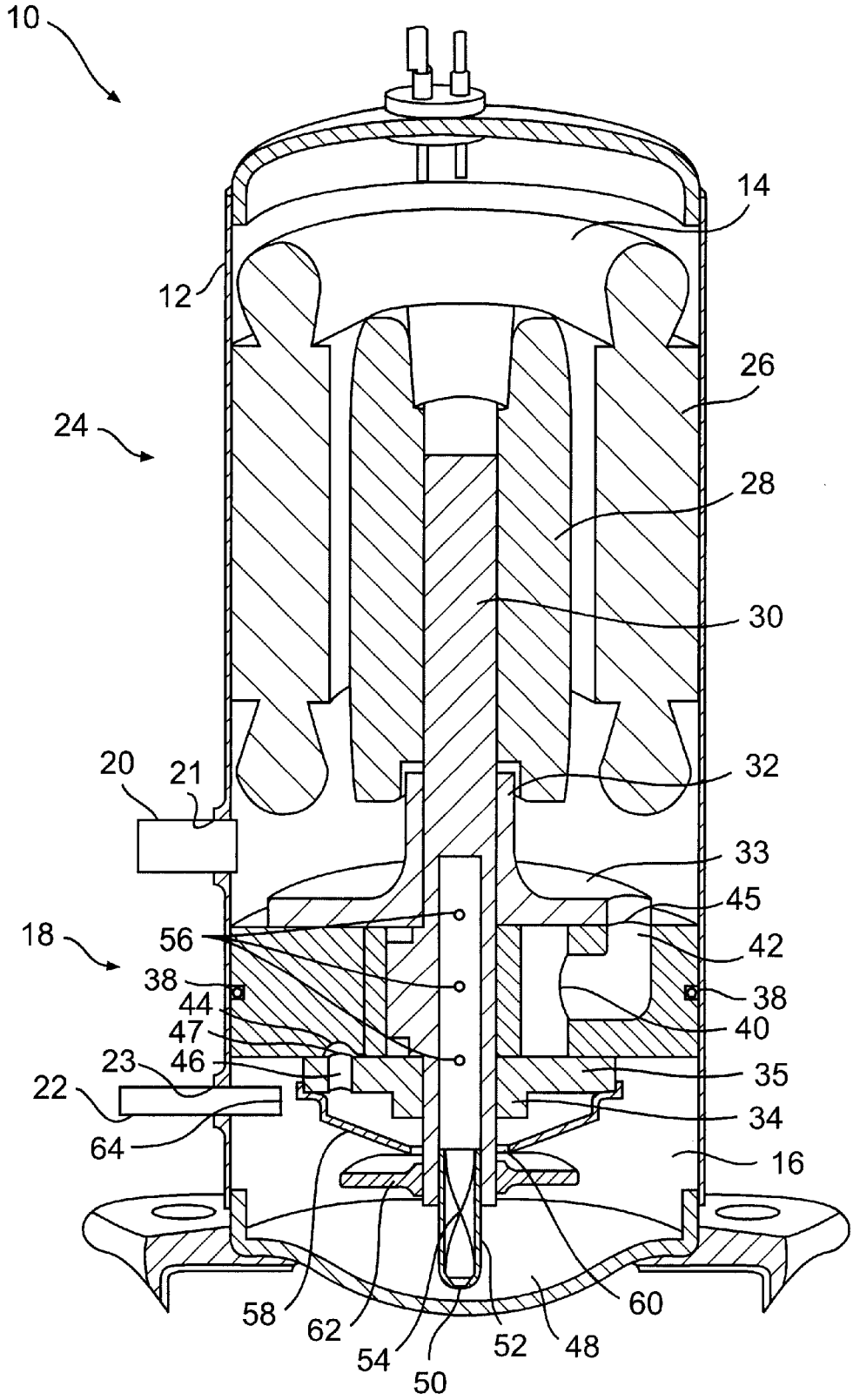
FIG. 3 is a cross-sectional view of a third embodiment of the present invention.

In the third embodiment of the invention, shown in FIG. 3, the compressor 18 itself divides the internal housing space into first and second chambers 14,16. A pressure seal 38 can be provided between the compressor 18 and the housing 12 to prevent fluid passage between the chambers 14,16, and thus maintain the pressure differential.

Figure 4:
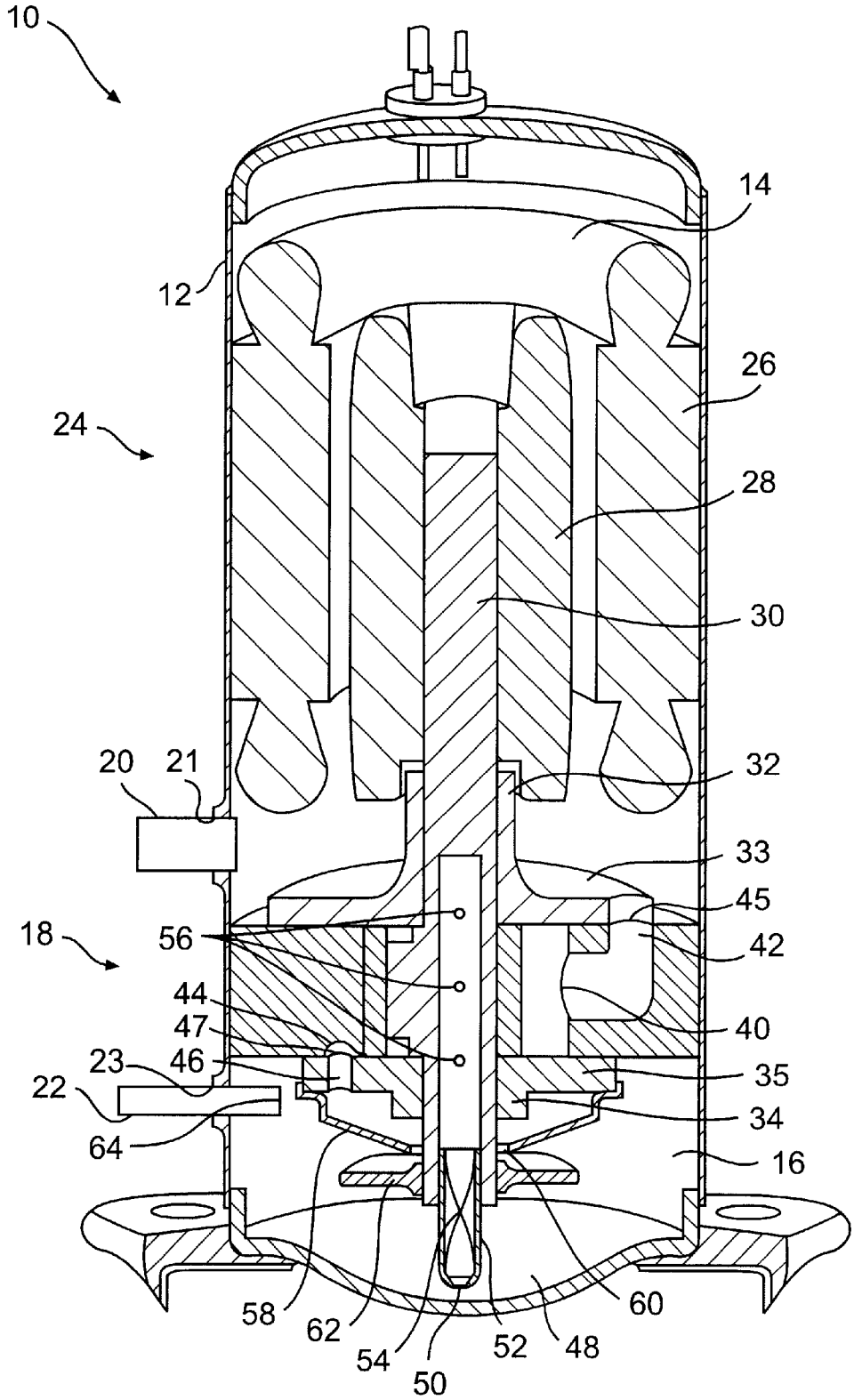
FIG. 4 is a cross-sectional view of a fourth embodiment of the present invention.

In the fourth embodiment, shown in FIG. 4, the compressor 18 is sealed within the housing 12, such as in a press fit arrangement, to prevent fluid passage between the chambers 14,16, and thus maintain the pressure differential. While a press fit arrangement is shown, other conventional sealing arrangements would perform equally well.

In the third and fourth embodiments, shown in FIGS. 3 and 4, respectively, the shaft 30 is supported by upper and lower shaft bearings 32,34 arranged on the compressor 18. The shaft bearings 32,34 are supported on respective shaft bearing plates 33,35.

In all embodiments of the invention, fluid from the first chamber 14 enters the compressor suction port 40 through a first fluid passage 42. In FIGS. 1–4, the first fluid passage 42 is shown to penetrate the upper shaft bearing plate 33 or the partition plate 36*b*. The opening of the first fluid passage defines a compressor inlet 45. Further, fluid from the compressor discharge port 44 enters the second chamber 16 through a second fluid passage 46. In FIGS. 1–4, the second fluid passage 46 is shown to penetrate the partition plate 36*a* or the lower shaft bearing plate 35. The opening of the second fluid passage defines a compressor outlet 47. It is noted that other paths for the first and second fluid passages 42,46 can be used, provided that they establish suitable fluid communication with the respective chambers 14,16.

The second chamber 16 houses an oil sump 48, shown in FIGS. 1–4, that serves as a reservoir for lubricating oil used by the compressor 18. Placement of the oil sump 48 in this high pressure chamber 16 facilitates both the process of supplying oil to the compressor 18 and the process of separating oil from the compressed fluid leaving the compressor 18.

Lubricating oil is supplied to the compressor 18 through a passage 50 in a second end of the shaft 30, which is immersed in the oil sump 48. An insert 52 with a paddle 54 is secured in the second end of the shaft 30, such that when the shaft 30 rotates, oil from the sump 48 is drawn into the passage 50. As the shaft 30 rotates, the oil continues to rise in the passage 50 until it reaches oil supply holes 56 that allow the oil to be distributed to the compressor 18 for lubrication.

During the compression process, the lubricating oil mixes with the fluid being compressed. To enhance the performance of the compressor system 10, it is desirable to separate the oil from the compressed fluid before the fluid leaves the housing 12 through the discharge tube 22. The oil separation is carried out using a baffle 58 secured around the lower shaft bearing 34. The baffle 58, shown in FIGS. 1–4, has a generally conical shape with a central opening 60, which accommodates the shaft 30 and provides an exit passage for the fluid and oil. Fluid from the compressor discharge port 44 is directed into the baffle 58, where oil in the fluid collects on the conical walls and drains through the central opening 60. The compressed fluid also passes through the central opening 60 and into the second chamber 16.

In a further embodiment of the invention, a weighted disk 62 can be secured to the shaft 30 in the second chamber 16, as shown in FIGS. 1–4. The disk 62 can function as both a shaft balancing weight and an oil separation device. As a balancing weight, the disk 62 acts to counteract eccentric loads on the shaft 30 introduced by the rotation of the rotor 28 and the operation of the compressor 18. The weighted disk 62 eliminates the need for balancing weights on the upper end of the rotor 28.

The disk 62 can also be used to separate oil from the compressed fluid. The oil and compressed fluid leaving the central opening 60 of the baffle 58 can be directed onto the weighted disk 62. The disk 62 centrifugally separates oil from the compressed fluid by propelling the oil outwardly onto the inner wall of the housing 12, from which it drains into the oil sump 48. The oil separation process, therefore, removes lubricating oil from the fluid leaving the compressor 18 and allows the oil to be reused.

The overall operation of the compressor system 10 will now be described. Activation of the motor 24 causes the shaft 30 to rotate, which in turn activates the compressor 18 and initiates the lubrication process described above. Operation of the compressor 18 causes fluid, such as refrigerant, to be drawn into the first chamber 14 through the suction tube 20. The fluid in the first chamber 14 is thereby maintained at the compressor suction pressure. In the first chamber 14 the fluid cools the motor 18 before moving into the first fluid passage 42, from which it enters the compressor suction port 40. As the fluid is compressed, it mixes with the oil used to lubricate the compressor 18.

The compressed fluid then leaves the compressor 18 through the compressor discharge port 44 and passes through the second fluid passage 46 into the baffle 58. In the baffle 58, lubricating oil is separated from the compressed fluid, and the oil and fluid pass through the central opening 60 into the second chamber 16. The fluid in the second chamber 16 is thereby maintained at the compressor discharge pressure.

The oil and fluid can be further separated by interacting with the weighted disk 62 on the shaft 30. The compressed fluid then passes out of the second chamber 16 through the discharge tube 22. The inlet 64 of the discharge tube 22 is positioned in an upper portion of the second chamber 16 to avoid drawing in oil propelled by the weighted disk 62.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A compressor system, comprising:

a housing;

a partition within the housing defining a first chamber and a second chamber;

a motor disposed in the first chamber;

a compressor disposed in the first chamber operably connected to the motor;

an oil sump disposed in the second chamber;

a first orifice in the housing communicating a suction tube with the first chamber; and a second orifice in the housing communicating the second chamber with a discharge tube, wherein fluid in the first chamber is at compressor suction pressure and fluid in the second chamber is at compressor discharge pressure.

2. The compressor system of claim 1, further comprising:

a first fluid passage communicating the first chamber with a suction port of the compressor; and a second fluid passage communicating a discharge port of the compressor with the second chamber.

3. The compressor system of claim 2, wherein one of the first fluid passage and the second fluid passage comprises an orifice in the partition.

4. The compressor system of claim 1, wherein the compressor is operably connected to the motor by a shaft passing through the partition.

5. The compressor system of claim 4, further comprising:

a weight disposed on the shaft in the second chamber balancing the shaft.

6. The compressor system of claim 5, wherein the weight comprises a disk positioned so that fluid discharged from the compressor is directed onto the disk, whereby oil is centrifugally separated from the fluid.

7. The compressor system of claim 4, wherein the partition comprises a shaft bearing.

8. The compressor system of claim 1, wherein the first orifice is in a location between the partition and the motor.

9. A compressor system, comprising:

a housing;

a compressor disposed within the housing dividing an interior housing space into a first chamber and a second chamber, wherein the compressor is sealed with respect to the housing to prevent the passage of fluid between the chambers;

a motor disposed in the first chamber operably connected to the compressor by a shaft extending from the motor into the second chamber;

an oil sump disposed in the second chamber;

a first orifice in the housing communicating a suction tube with the first chamber; and a second orifice in the housing communicating the second chamber with a discharge tube, wherein fluid in the first chamber is at compressor suction pressure and fluid in the second chamber is at compressor discharge pressure.

10. The compressor system of claim 9, wherein the compressor is sealed with respect to the housing with at least one of a pressure seal and a press fit.

11. The compressor system of claim 9, wherein the first orifice is in a location between the compressor and the motor.

12. The compressor system of claim 9, further comprising:

a weight disposed on the shaft in the second chamber balancing the shaft.

13. The compressor system of claim 12, wherein the weight comprises a disk positioned so that fluid discharged from the compressor is directed onto the disk, whereby oil is centrifugally separated from the fluid.

14. A compressor system, comprising:

a housing;

a partition within the housing defining a low pressure housing portion and a high pressure housing portion;

a motor in the low pressure housing portion;

a compressor in the low pressure housing portion operably connected to the motor;

an oil sump in the high pressure housing portion;

a first orifice in the housing communicating a suction tube with the low pressure housing portion;

a first fluid passage communicating the low pressure housing portion with a suction port of the compressor;

a second fluid passage communicating a discharge port of the compressor with the high pressure housing portion; and a second orifice in the housing communicating the high pressure housing portion with a discharge tube, wherein oil in fluid discharged from the compressor is deposited in the oil sump.

15. The compressor system of claim 14, wherein the compressor maintains the low pressure housing portion at suction pressure and the high pressure housing portion at discharge pressure.

16. The compressor system of claim 14, wherein the fluid discharged from the compressor is directed onto a rotating disk that centrifugally separates the oil from the fluid.

17. The compressor system of claim 14, wherein one of the first fluid passage and the second fluid passage includes an orifice in the partition.

18. A compressor system, comprising:

a housing;

a compressor within the housing dividing an internal housing space into a low pressure housing portion and a high pressure housing portion, wherein the compressor is sealed with respect to the housing to prevent fluid flow between the housing portions;

a motor in the low pressure housing portion operably connected to the compressor by a shaft extending from the motor into the high pressure housing portion;

an oil sump in the high pressure housing portion;

a first orifice in the housing communicating a suction tube with the row pressure housing portion;

a first fluid passage communicating the Sow pressure housing portion with a suction port of the compressor;

a second fluid passage communicating a discharge port of the compressor with the high pressure housing portion; and a second orifice in the housing communicating the high pressure housing portion with a discharge tube, wherein oil in fluid discharged from the compressor is deposited in the oil sump.

19. The compressor system of claim 18, wherein the compressor is sealed with respect to the housing with at least one of a pressure seal and a press fit.

20. The compressor system of claim 18, wherein the compressor maintains the low pressure housing portion at suction pressure and the high pressure housing portion at discharge pressure.

21. The compressor system of claim 18, wherein the fluid discharged from the compressor is directed onto a rotating disk disposed on the shaft that centrifugally separates the oil from the fluid.

22. A compressor system having a first chamber at suction pressure and a second chamber at discharge pressure, the system comprising:

a housing;

a partition within the housing defining the first chamber and the second chamber;

a first orifice in the housing communicating a suction tube with the first chamber;

a second orifice in the housing communicating the second chamber with a discharge tube;

a motor disposed in the first chamber having a shaft passing through the partition;

a compressor disposed in the first chamber operably connected to the shaft, the compressor comprising:

a compressor inlet communicating the first chamber with a compression volume; and a compressor outlet communicating the compression volume with the second chamber; and an oil sump disposed in the second chamber.

23. The compressor system of claim 22, wherein the compressor outlet passes through the partition.

24. The compressor system of claim 22, further comprising:

an oil separation device disposed in the second chamber interacting with fluid from the compressor outlet to separate oil from the fluid.

25. The compressor system of claim 24, wherein the oil separation device comprises a disk disposed on the shaft that propels the oil onto an inner surface of the housing.

26. The compressor system of claim 25, wherein the disk is weighted to balance the shaft.

27. The compressor system of claim 22, wherein the partition comprises a shaft bearing.

28. The compressor system of claim 22, wherein the first orifice is in a location between the partition and the motor.

29. A compressor system having a first chamber at suction pressure and a second chamber at discharge pressure, the system comprising:

a housing;

a compressor disposed within the housing dividing an interior housing space into the first chamber and the second chamber, the compressor comprising:

a compressor inlet communicating the first chamber with a compression volume; and a compressor outlet communicating the compression volume with the second chamber, wherein the compressor is sealed with respect to the housing to prevent fluid flow between the chambers;

a first orifice in the housing communicating a suction tube with the first chamber;

a second orifice in the housing communicating the second chamber with a discharge tube;

a motor disposed in the first chamber having a shaft driving the compressor wherein the shaft extends from the motor into the second chamber; and an oil sump disposed in the second chamber.

30. The compressor system of claim 29, wherein the compressor is sealed with respect to the housing with at least one of a pressure seal and a press fit.

31. The compressor system of claim 29, further comprising:

an oil separation device disposed in the second chamber interacting with fluid from the compressor outlet to separate oil from the fluid.

32. The compressor system of claim 31, wherein the oil separation device comprises a disk disposed on the shaft that propels the oil onto an inner surface of the housing.

33. The compressor system of claim 32, wherein the disk is weighted to balance the shaft.

34. The compressor system of claim, 29 wherein the first orifice is in a location between the compressor and the motor.

35. A compressor system, comprising:

a housing;

a partition within the housing defining a low pressure housing portion and a high pressure housing portion;

a motor in the low pressure housing portion;

a compressor in the housing operably connected to the motor;

an oil sump in the high pressure housing portion;

a first orifice in the housing communicating a suction tube with the low pressure housing portion;

a first fluid passage communicating the low pressure housing portion with a suction port of the compressor;

a second fluid passage communicating a discharge port of the compressor with the high pressure housing portion; and a second orifice in the housing communicating the high pressure housing portion with a discharge tube, wherein fluid discharged from the compressor is directed onto a rotating disk that centrifugally separates the oil from the fluid such that the oil is deposited in the oil sump.

* * * * *

UNITED STATES PATENT AND TRADEMARK OFFICE

CERTIFICATE OF CORRECTION

PATENT NO. : 6,499,971 B2 
DATED : December 31, 2002
INVENTOR(S) : John K. Narney, II et al.

It is certified that error appears in the above-identified patent and that said Letters Patent is hereby corrected as shown below:

Column 8,
Line 53, “row pressure” should read -- low pressure --.
Line 54, “Sow pressure” should read -- low pressure --.

Signed and Sealed this

Fourth Day of March, 2003

JAMES E. ROGAN
*Director of the United States Patent and Trademark Office*